US011319033B2

(12) United States Patent
Gatouillat et al.

(10) Patent No.: US 11,319,033 B2
(45) Date of Patent: May 3, 2022

(54) SYSTEM FOR TRANSFER OF A FLUID PRODUCT

(71) Applicant: FMC Technologies, Sens (FR)

(72) Inventors: Guillaume Gatouillat, La Chapelle sur Oreuse (FR); Stéphane Paquet, Voisines (FR)

(73) Assignee: FMG Technologies, Sens (FR)

( * ) Notice: Subject to any disclaimer, the term of this patent is extended or adjusted under 35 U.S.C. 154(b) by 0 days.

(21) Appl. No.: 17/272,304

(22) PCT Filed: Sep. 12, 2019

(86) PCT No.: PCT/EP2019/074430

§ 371 (c)(1),
(2) Date: Feb. 28, 2021

(87) PCT Pub. No.: WO2020/053366

PCT Pub. Date: Mar. 19, 2020

(65) Prior Publication Data

US 2021/0179235 A1 Jun. 17, 2021

(30) Foreign Application Priority Data

Sep. 14, 2018 (FR) ..... 1858332

(51) Int. Cl.
*B67D 9/02* (2010.01)
*B63B 27/34* (2006.01)

(52) U.S. Cl.
CPC ..... *B63B 27/34* (2013.01); *B67D 9/02* (2013.01)

(58) Field of Classification Search
CPC ..... B63B 27/34; B63B 27/30; B63B 27/24; B67D 9/02; B67D 9/00
See application file for complete search history.

(56) References Cited

U.S. PATENT DOCUMENTS

| | | | | |
|---|---|---|---|---|
| 3,085,593 | A | 4/1963 | Sorensen | |
| 9,708,040 | B2 * | 7/2017 | Le Devehat | B67D 9/02 |
| 10,087,067 | B2 * | 10/2018 | Perdrix | B63B 27/25 |
| 2017/0057806 | A1 | 3/2017 | Perdrix et al. | |
| 2018/0105234 | A1 | 4/2018 | Perdrix et al. | |

* cited by examiner

*Primary Examiner* — Jason K Niesz

(57) ABSTRACT

A system (1) for transfer of a fluid product comprising a transfer pipe for the fluid product having several sections, called first pipe (2), and having an end provided with a coupling system (5) configured for the connection of the first pipe (2) to a target duct, and further comprising a support structure (4) for the first pipe (2), comprising an inner branch (41) which is mounted on a base (42) and an outer branch (43). The first transfer pipe (2) comprises a flexible section of pipe (21) having a proximal end (210) suspended from the support structure (4) and a rigid section of pipe (22) connected to a distal end (211) of the flexible section of pipe (21) and provided at its free end with the coupling system (5), the transfer system comprising suspension means configured for rigidly suspending, at the location of a first end thereof, the rigid section of pipe (22) from the outer branch (43) via articulation means permitting rotation around a vertical axis and at least one horizontal axis.

20 Claims, 5 Drawing Sheets

SYSTEM FOR TRANSFER OF A FLUID PRODUCT

BACKGROUND OF THE INVENTION

The present invention concerns a system or arm for transfer of a fluid product, in particular petroleum or gas products.

It is more particularly a transfer system, also called loading arm, dedicated to bunkering or supplying a ship's hold with hydrocarbons. Such a loading arm is generally installed on a medial plane of a supply ship and may be connected to supplied or receiving ships or boats moored to port or starboard. The supply or transfer of hydrocarbons is thus made for a fixed installation or a floating installation. This type of supply operation is known in the industry as "bunkering" or "fuelling".

The hydrocarbons from the hold serve as fuel for the machinery of ships of the ferry, containership, etc. type. The hydrocarbons are for example petroleum products, liquefied petroleum gas (LPG) or liquefied natural gas (LNG). The use of LNG is increasingly favored since it enables the environmental footprint of maritime and river transport to be reduced.

In the state of the art, the loading arms used are generally arms of the compass type comprising one or more flexible or rigid transfer pipes and further comprising a rigid support structure for said flexible or rigid pipes.

Document US 2017 005 78 06 discloses a transfer system comprising at least one flexible pipe, a support structure for said flexible pipe, the flexible pipe having a proximal end suspended from the support structure and a distal end provided with a coupling system configured for the connection to a target duct, and a cable or a jack making it possible to continuously supply a tension on the coupling system during the supply or transfer operation and which is linked both to the support structure and to the coupling system.

In such a transfer system the end of the system is manipulated via cables and winches. At the time of supply, the flexible pipes are thus in motion, thereby making it difficult to predict and anticipate the positions (relative angles and distances in the three dimensions) of the various members that compose the transfer system. Furthermore, the use of cables requires the action of one or more operators to finalize the connection to the target duct.

Furthermore, the coupling system of document US 2017 005 78 06 is difficult or even impossible to connect to a target duct that is located in a bottom or lower part of the hull of a supply ship for example. In particular, the connection is difficult when the target duct is located behind a hatch door or in a recessed zone of the hull, requiring a lateral approach (connection from the side along a horizontal plane). However, it is sometimes necessary to access these restricted zones, whether they be low down or on the contrary high up, at the time of the supply operation.

SUMMARY OF THE INVENTION

The present invention is directed to solving at least one of the aforesaid drawbacks. For this, the invention provides a system for transfer of a fluid product having an optimized structure and arrangement.

Thus the invention relates to a system for transfer of a fluid product comprising a transfer pipe having several sections, called first pipe, and having an end provided with a coupling system configured for the connection of the pipe to a target duct, and further comprising a support structure for the pipe or pipes, comprising an inner branch which is mounted on a base and an outer branch. The transfer pipe comprises a flexible section of pipe having a proximal end suspended from the support structure and a rigid section of pipe connected to a distal end of the flexible section of pipe and provided at its free end with the coupling system, the transfer system comprising suspension means configured for rigidly suspending, at the location of a first end thereof, the rigid section of pipe from the outer branch via articulation means permitting two rotational movements around a vertical axis and at least one horizontal axis.

The transfer system is thus composed of a static part formed by the support structure, as well as by a dynamic part formed by the flexible section or sections of pipe, by the rigid section or sections of pipe and by the coupling system. During the supply or loading operation, the static part remains immobile. This thus avoids creating stresses to which the supply ship would be subject and which would perturb the conduct of the loading.

Furthermore, the transfer system is designed such that it has a continuity, that is to say throughout the transfer system, with respect to the rigid connections that are articulated without any redundant degree of freedom. In particular, the rigid section of pipe to which is connected the flexible section of pipe that is liable to move during the supply, is rigidly connected to the outer branch. The monitoring or "surveillance" of the various members of the transfer system and thus the tracking of the relative positions of the two boats, the supply one and the supplied one, may thus be carried out easily during the loading operation. Thus, since the entire static part is immobile and the members of the transfer system are rigidly linked together, the position of the various members of the transfer system at each instant can be determined merely through geometrical calculations. These calculations may be carried out for example on the basis of data collected by sensors. This monitoring operation is important since on account of the movement of the ships under the effect of external actions such as the wind and the swell, it is important to be able to check the positions of the members of the transfer system at every instant and thus to be able to put them back into the right position or trigger an emergency release sequence when necessary.

Furthermore, the suspension means the degree of freedom of which may or may not be driven by actuators make it possible to obtain a large zone of coverage by the transfer system. In particular, this makes it possible to manipulate the dynamic part, and to make a connection to the target duct without manual assistance by an operator, including in zones that are restricted or difficult to access requiring a lateral approach.

Lastly, on account of the absence of cables, the transfer system so constituted does not require the use of a lifting apparatus such as a winch or a lowering assistance or retaining system for the flexible sections of pipe.

According to a feature, the first pipe is configured for the transfer of a cryogenic product, such as liquefied natural gas, and the system comprises a second pipe for transfer of fluid product, preferably for return of gas vapors, the second pipe comprising a second rigid section of pipe upstream of a second coupling system.

According to another feature, the suspension means comprise a suspension arm connected to the outer branch at the location of the first end.

According to a feature, the suspension arm is connected at the location of a second end, which is an opposite end to the first end, to a bar, opposite locations of said bar being connected to the rigid sections of pipe of the first transfer pipe and of the second pipe by horizontal pivot connections, the suspension arm and the bar together forming a T.

According to a feature, the rigid section of the second pipe is suspended from the outer branch by a second suspension arm connected to the outer branch via articulation means, each of the two suspension arms being connected to one of the rigid sections of the first and second transfer pipes by two pivot connections of horizontal axis, the two suspension arms being connected to each other by a cross-member forming a yoke with the articulation means and bearing the two suspension arms.

According to a feature, the suspension means are formed by a portion of the rigid section of the second pipe, the rigid section of the second pipe comprising assembly means enabling the fastening of the rigid section of the second pipe to the rigid section of the first pipe.

According to a feature, the inner branch is rotatably mounted on the base, around a horizontal axis by a first end, the outer branch being connected to the inner branch at a second end which is an opposite end to the first end, by a pivot connection enabling the outer branch to turn around a horizontal axis extending parallel to the horizontal rotational axis of the inner branch.

According to another feature, the inner branch is rotatably mounted on the base, around a vertical axis.

According to a feature, the transfer system comprises actuating means to actuate the rotational movements of the inner and outer branches.

According to another feature, the transfer system comprises actuating means for actuating the rotational movements of the suspension means and/or of the rigid section or sections of pipes.

According to a feature, the actuating means comprise a jack or a motor for each rotational movement to actuate.

According to another feature, the or each coupling system comprises a coupler with three degrees of rotational freedom and, optionally, rotation in at least one of the three degrees of rotational freedom is actuated by an actuator.

According to a feature, the or each coupling system is equipped with an emergency release system comprising two valves which are juxtaposed using a collar of which the opening is controlled by at least one actuator, said at least one actuator also directly or indirectly controlling the closing of the valves.

According to another feature, the articulation means comprise a rolling bearing with a vertical rotational axis which is joined to a clevis connected by a pivot connection to the outer branch.

According to another feature, the or each coupling system comprises a balancing device suitable for maintaining the coupler in a position enabling its connection to the associated target duct.

According to another feature, the second pipe comprises a flexible portion disposed between the rigid section and the second coupling system.

According to a feature, the second pipe comprises a flexible section of pipe having a proximal end and a distal end which is an opposite end to the proximal end, the distal end being connected to the rigid section of pipe and the proximal end of the flexible section of pipe of the first pipe and/or of the second pipe being connected to a rigid section of pipe carried by the inner branch or by the outer branch.

According to a feature, the or each flexible section of pipe is articulated to the rigid section of pipe that is associated and that carries the associated coupling system with two degrees of rotational freedom.

According to a feature, the pivot connection connecting the outer branch to the inner branch is adapted to enable folding of the outer branch onto the inner branch in a storage position of the system for transfer of a fluid product.

Still other particularities and advantages of the invention will appear in the following description.

BRIEF DESCRIPTION OF THE DRAWINGS

In the accompanying drawings, given by way of non-limiting examples.

DETAILED DESCRIPTION OF THE INVENTION

Figure 1:
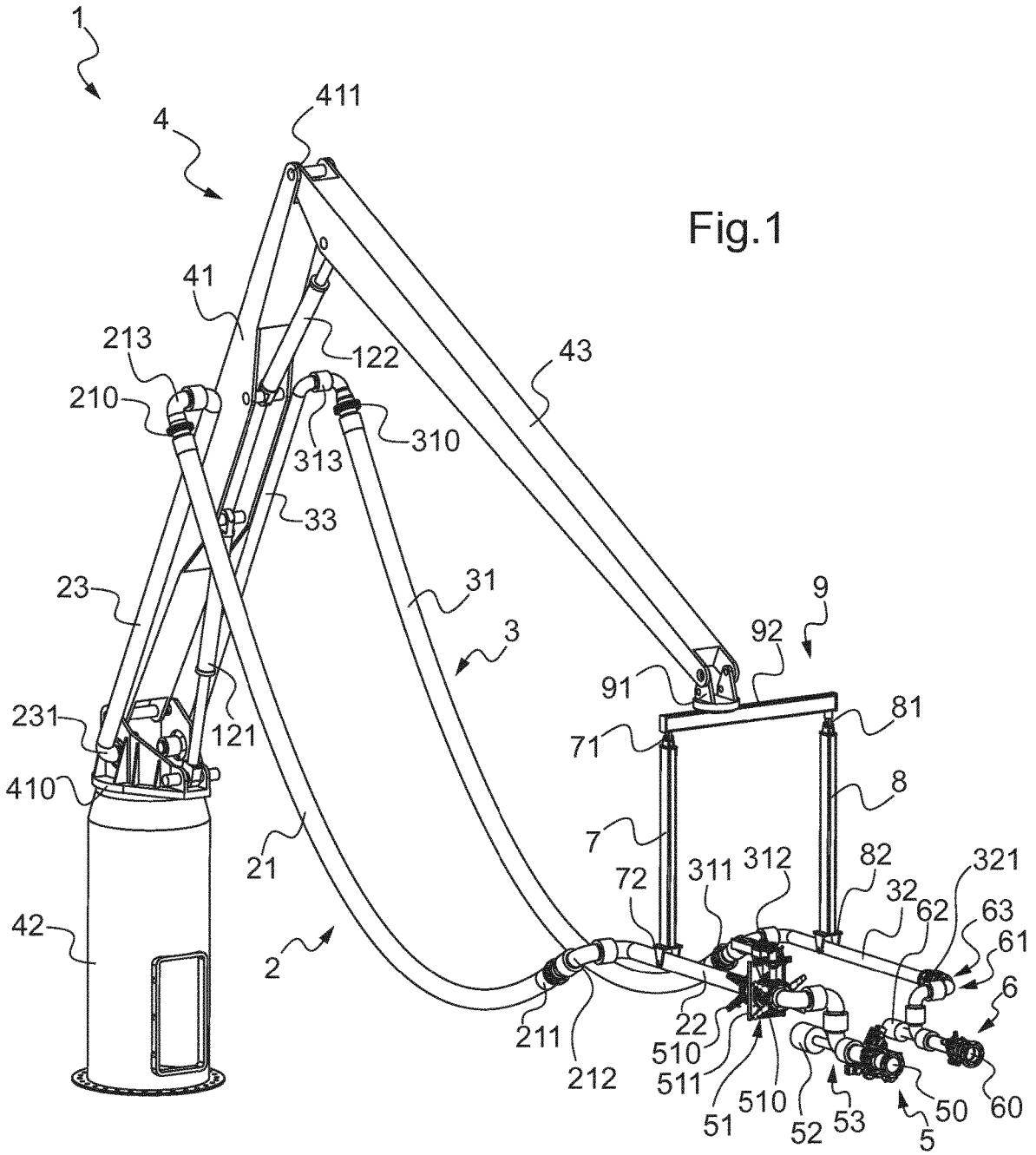
FIG. 1 is a perspective view of the system for transfer of a fluid product according to a first embodiment.

FIGS. 1 to 4 illustrate a first embodiment of the transfer system or transfer arm 1. The transfer system 1 is configured for the supply with hydrocarbons of a receiving ship not illustrated in the figures.

In the present document, reference is made to the resting and loading positions. The transfer system 1 is in resting position when it is not in course of loading or supply with hydrocarbons. This is the case for example if the transfer system 1 is not connected to the receiving ship. As regards the loading position, this corresponds to a case in which the transfer system 1 is in course of being supplied by a ship.

In this first example embodiment, the transfer system 1 comprises two fluid transfer pipes 2, 3 and a support structure 4 for the pipes 2,3. The first pipe 2 or liquid line or product pipe is configured here to convey hydrocarbon, in particular LNG from the supply ship to the supplied ship. The second pipe 3 or vapor line is provided here for the return to the supply ship of the displaced vapors of gas generated during the transfer.

Of course, the pipes may be configured to convey other products.

The support structure 4 is so named since it makes it possible to take the loads of the pipes 2, 3. The support structure 4 enables the forces generated during the supply operation to be taken up but also enables the mass of the pipes 2, 3 to be supported whether said pipes 2, 3 are at rest or operational.

The transfer pipes 2, 3 comprise several sections connected to each other by fluid-tight articulations. In this example embodiment, the pipes 2, 3 each comprises three sections. The pipe 2 comprises a flexible section of pipe 21 of which opposite locations are connected to a first rigid section of pipe 22 and to a second rigid section of pipe 23. The pipe 3 comprises a flexible section of pipe 31 of which opposite locations are connected to a first rigid section of pipe 32 and to a second rigid section of pipe 33. In this example embodiment, the first rigid sections of pipe 22, 32 extend horizontally.

The support structure 4 comprises an inner branch 41 mounted on a base 42, and of which opposite locations are connected to an outer branch 43. The inner branch 41 comprises a first end 410 connected to the base and a second end 411 connected to the outer branch 43. The support structure 4 is structurally close to a crane here. The base 42 serves to support the inner and outer branches 41, 42. In the present embodiment, the inner branch 41 is rotatably mounted on the base 42 at the first end 410, around a vertical axis and a horizontal axis, in order to be able to raise the loading arm 1 and lower it. A pivot connection enables the connection between the inner branch 41 and the outer branch 43 at the second end 411 and allows the outer branch 43 to turn around a horizontal axis extending parallel to the horizontal rotational axis of the inner branch 41.

In this document, reference is made to axes or directions that are horizontal and vertical. By horizontal axis is meant an axis belonging to a plane parallel to a reference plane on which rests the transfer system and in particular the base 42. By vertical axis is meant an axis that is perpendicular to the reference plane.

Each flexible section of pipe 21, 31 comprises a proximal end 210, 310 suspended from the inner branch 41. In this first example embodiment, the proximal ends 210, 310 of the flexible sections of pipe 21, 31 are respectively connected to the second rigid sections of pipe 23, 33. In this example embodiment, the second rigid sections of pipe 23, 33 are carried by the inner branch 41. The first rigid sections of pipe 22, 32 are respectively connected to the distal ends 211, 311 of the flexible sections of pipe 21, 31.

Each flexible section of pipe 21, 31 is connected, at the location of the distal ends 211, 311, to the associated first rigid section of pipe 22, 32 by means of articulated assemblies 212, 312 comprising two elbow bends and two swivel joints each, thus enabling two degrees of rotational freedom. Each flexible section of pipe 21, 31 is connected, at the location of the proximal ends 210, 310, to the associated second rigid section of pipe 23, 33 by means of articulated assemblies 213, 313 comprising two elbow bends and one swivel joints enabling a rotational movement in the horizontal plane.

The end of the rigid pipes 23, 33 comprises two other articulated assemblies 231, 331 comprising two joints and two elbow bends. The articulated assemblies 231, 331 enable the rotational movements with a horizontal axis and a vertical axis between the inner branch 41 and the base 42.

Figure 2:
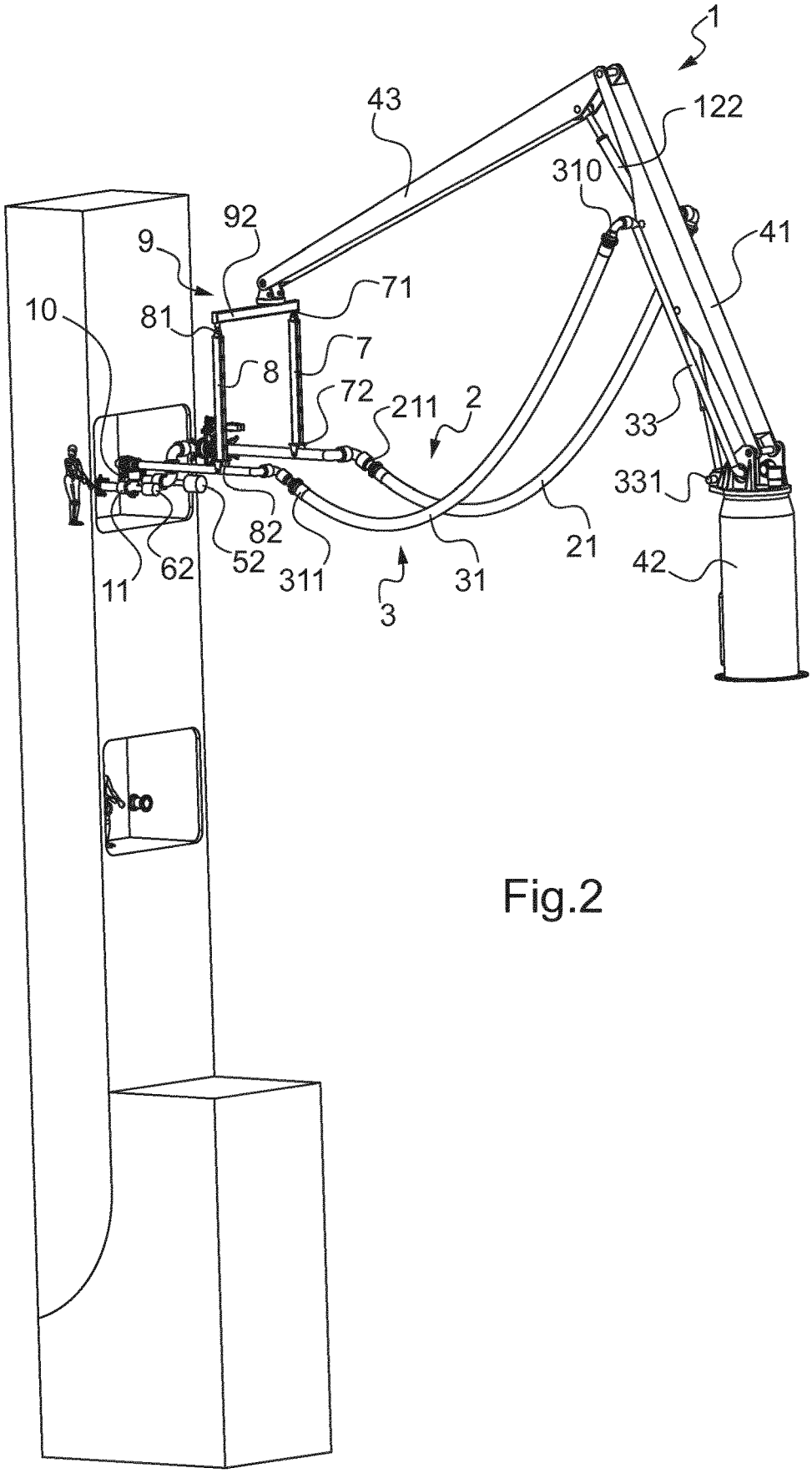
FIG. 2 is a perspective view of the transfer system of FIG. 1 connected to two target ducts.
Figure 3:
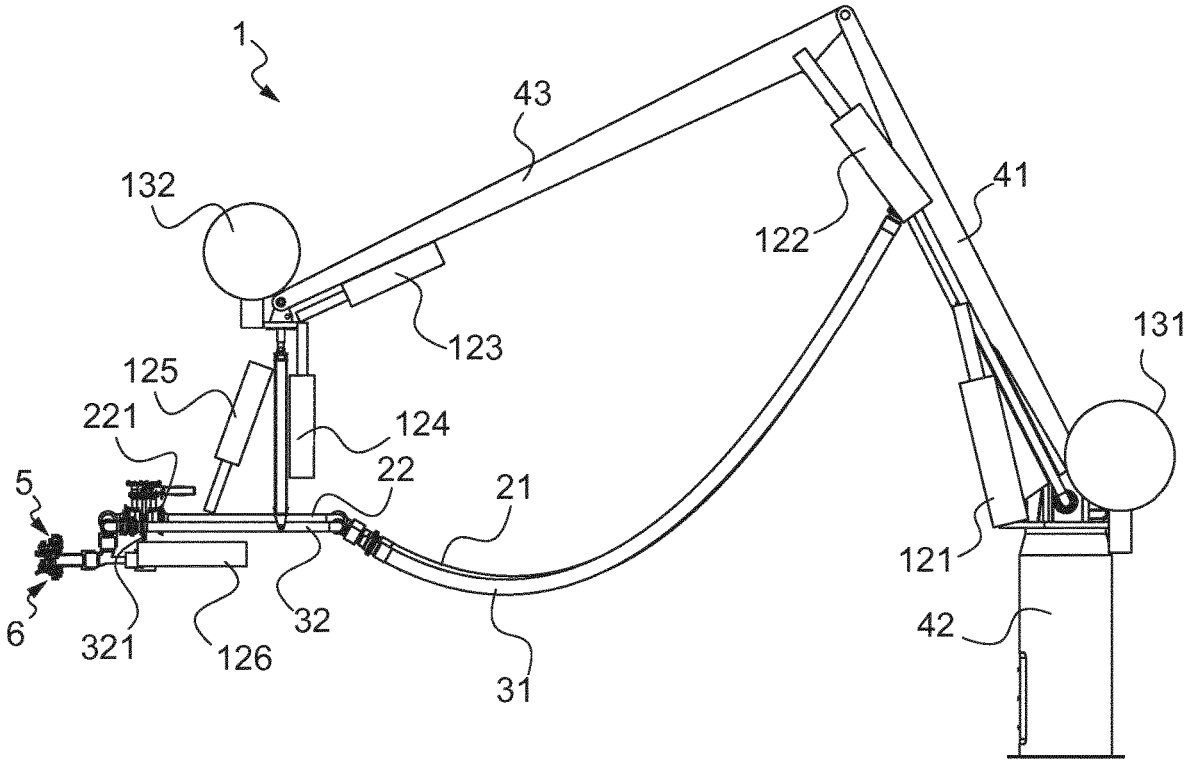
FIG. 3 is a side view of the transfer system of FIG. 1.

Each first rigid section of pipe 22, 32 is furthermore provided at its free end 221, 321 with a coupling system 5, 6. The coupling systems 5, 6 of the first rigid sections of pipe 22, 32 are intended for the respective connections of the pipes 2, 3 to target ducts 10, 11 as illustrated in FIG. 2. Each coupling system 5, 6 comprises a coupler 50, 60 articulated at the end of the rigid section of pipe with three degrees of rotational freedom and, optionally, rotation in at least one of the three degrees of rotational freedom is controlled by an actuator. The coupling system 5 of the first pipe 2 in this example embodiment is a hydraulic coupling system. The coupling system 6 of the second pipe 3 is here a manual coupling system.

The rigid sections of pipe 22, 32 are each provided with an emergency release system 51, 61 (ERS), known per se. The emergency release systems are respectively arranged upstream of each coupling system 5, 6. Each emergency release system 51, 61 comprises two valves 510, 610 which are juxtaposed using a collar 511, 611 the opening of which is controlled for example by an actuator. The valves may be butterfly valves or ball valves or flap valves. The actuator may also control the closing of the valves.

Each coupling system 5, 6 comprises a passive balancing device 52, 62 for example a counterweight or a spring, configured to keep the couple 50, 60 in a position enabling its connection to the associated target duct 10, 11.

The coupling systems 5, 6 comprise fluid-tight articulations enabling the connection to the free ends 221, 321 of the first rigid sections of pipe 22, 31. In the described example embodiment, the fluid-tight articulations are articulated assemblies 53, 63 each formed by the combination of at least one elbow bend and at least one swivel joint, here cryogenic. In the example embodiment described, the articulated assemblies 53, 63 comprise three elbow bends and three swivel joints which from one to the next are at right angles i.e. they are oriented in the three translation directions.

The fluid-tight articulations or assemblies that are articulated between the different members of the transfer system are here of cryogenic swivel joint type. Of course, these articulations may be of any other type providing rotation around an axis of the two ends which are connected to it as well as the transfer of mechanical forces and the fluid-tight interior conveyance of the product.

In the case of the first embodiment, the swivel joints are eight in number for each of the first and second pipes 2, 3. The articulated assemblies are configured so as to confer to each of the pipes 2, 3 six degrees of freedom: the three coordinates for translation as well as the angles of roll, pitch, yaw (Euler angles), or, as a variant, their nautical equivalent.

In the example embodiment, each first rigid section of pipe 22, 32 is suspended from the outer branch 43 by a suspension arm 7, 8. The suspension arms 7, 8 extend vertically here. Each suspension arm 7, 8 comprises a first end 71, 81 and a second end 72, 82 which is an opposite end to the first end 71,81. The first end 71, 81 of each suspension arm 7, 8 is connected to the outer branch 43 by a yoke 9. The yoke 9 comprises a clevis mounting 91 and a cross-member 92, which are linked by a pivot connection having a vertical axis. The horizontal clevis mounting 91 is connected to the outer branch 43 by a pivot connection having a horizontal axis. The cross-member 92 is connected to the suspension arms 7, 8 at the first ends 71, 81 by means of horizontal axis pivot connections. The cross-member 92 here extends horizontally. The first end 81 of the suspension arm 8 also comprises a vertical axis pivot connection configured to accommodate the variation in spacing between the coupling systems 5, 6. The second end 72, 82 of each suspension arm 7, 8 is respectively connected to the first rigid sections of pipe 22, 32, for example by means of a horizontal axis pivot connection.

The transfer system 1 so constituted comprises a dynamic part and a static part. In this example embodiment, the dynamic part comprises flexible sections of pipe 21, 31, the first rigid sections of pipe 22, 32 and the coupling systems 5, 6. The static part comprises the support structure 4 and the second rigid sections of pipe 23, 33. The transfer system 1 thus constituted makes it possible to obtain a static envelope that is very large, in particular vertically. Furthermore, once in loading position, the transfer system 1 enables a smaller local dynamic envelope to be obtained without having to move the static part. In loading position, the dynamic part is passive, that is to say it freewheels, and follows the relative movement between the two ships, the supplied one and the supply one, due to the swell.

By static envelope is meant the potential relative positions of the target ducts of the supplied ship relative to the coupling systems of the transfer pipes and in particular of the connection points of the transfer system. The spacing between the target ducts and the coupling systems is in particular due to the difference in size of the boats and due to the waterline according to the degree of loading.

Once the coupling systems of the pipes have been connected to the target ducts, that is to say once the transfer system is in loading position, the transfer system must be capable of following the movements due to the swell. By local dynamic envelope is meant the relative positions that can be reached by the target ducts of the supplied ship under the effect of the swell.

The structure of the transfer system 1 is hybrid on account of the presence of pipes with flexible and rigid sections, and on account of the presence of a dynamic part and of a static part.

In the first embodiment illustrated, the transfer system 1 comprises actuators or actuation names, for example hydraulic jacks 121, 122, 123 enabling the inclination of the different members of the transfer system 1 to be controlled. In this example, the transfer system 1 comprises three hydraulic jacks 121, 122, 123 for the static part configured to control the inclination of the inner branch 41 and of the outer branch 43, and three hydraulic jacks 124, 125, 126 for the dynamic part configured to control the suspension arms 7, 8, the rigid sections 22, 32 and the articulated assemblies of the coupling systems 5, 6. The three jacks 124, 125, 126 of the dynamic part are mounted here on the first pipe 2. Furthermore, the transfer system 1 comprises two hydraulic motors 131, 132 respectively for the static and dynamic parts. The hydraulic motors are configured to enable the rotation of the different members constituting the transfer system 1.

The jacks 124, 125, 126 for inclination and orientation as well as the hydraulic motor 132 of the dynamic part are disengageable, so as to be able to be disengaged or set to "freewheel" once the pipes 2 and 3 have been connected to the target ducts 10, 11, while the actuators of the static part remain locked such that the static part follows the movement of the supply ship.

The operation of all the actuators is coordinated by a hydraulic circuit and an electrical circuit (not shown), which are controlled by a programmable logic controller of any appropriate type known per se.

In one embodiment, the transfer system 1 comprises sensors making it possible to continuously check the position of the transfer system 1 and of the various members constituting said transfer system. Thus, the transfer system may comprise angle sensors enabling real-time measurement of the position of the coupling system 5 of the first pipe 2 relative to the end of the outer branch, as well as real-time measurement of the position of the end of the outer branch relative to the base. This enables repositioning of the end of the outer branch relative to the target duct during the transfer of the product to accommodate, if necessary, the variations in draughts of the boats and to trigger an emergency release sequence of the transfer system if the movements of the target duct approach the kinematic limits of the transfer system. By way of non-limiting examples, the sensors may be proximity sensors, inclinometers, potentiometers or coders. This monitoring may be carried out in combination with control software for continuous checking of the position of the system, also called CPMS (standing for "Constant Position Monitoring System").

In an example embodiment, the transfer system 1 comprises a Local Control Panel comprising an industrial PLC (standing for "Programmable Logic Controller") and an HPU (standing for "Hydraulic Power Unit"). The transfer system 1 may also comprise remote control means as well as one or more hydraulic accumulators.

The connection kinematics of the transfer system 1 are as follows. The transfer system 1 is first of all extended from a resting position. The transfer system 1 must be placed sufficiently close to the ship to be supplied so as to place the target duct within an envelope defined for the connection of the coupling system and the target duct reachable by the dynamic part.

In a first phase, all the actuators of the static part and of the dynamic part are locked or operated. In other words, the actuators cannot be set to freewheel. An approach phase is begun, during which the static part is extended so as to place the coupling system 5 of the first pipe 2 near the target duct 10 receiving the hydrocarbon (LRV "LNG fuelled Receiving Vessel"). Next, the operator completes the connection of the first pipe 2 or liquid line by moving the dynamic part and closing the associated coupling system 5, for example by virtue of remote control means.

In a second phase, the operator allows the "freewheel" mode solely for any actuators of the dynamic part. In other words, once the transfer system has been coupled to the target duct 10 of the coupling system 5, the actuating means of the inner branch and of the outer branch are locked and the actuating means of the suspension means are set to freewheel. The suspension means, in this example the yoke, set to freewheel, then make it possible to accommodate the movements of the target duct relative to the end of the outer branch due to the movements of the floating bodies at the frequency of the waves.

Next, the vapor line 3 is connected. This step may be carried out automatically or manually. For example, the connection may be made by virtue of lifting means, for example a hoist. The coupling system 6 of the vapor line 3 is open and connected to the target duct 11 for vapor. In one example embodiment, the lifting means or member may form part of the transfer system. In case of absence of lifting means, the vapor line 3 may be balanced so as to be manipulable by an operator with a small force.

During the phase of connection or loading, the static part is locked and follows the movements of the supply ship. The dynamic part freewheels and follows the relative movements between the two ships, the supplied one and the supply one.

Once the supply operation has been terminated, the transfer system 1 is disconnected. The disconnection is carried out by following, in reverse order, the same steps described above for the connection. Once the disconnection has been achieved, the transfer system 1 may be stored Emergency release is carried out by means of the valves of the ERS ("Emergency Release System"). The release valves close and then the emergency release coupling formed by a PERC collar (PERC standing for "Powered Emergency Release Collar") is liberated. Some of the members, in particular the associated coupling system and the articulated assemblies then remain connected to the ship to supply.

Once the situation has been rendered safe or danger has been ruled out, the emergency release system is assembled again so as to enable resumption of the supply. For this, the transfer system is brought onto the supply boat in order to receive a recovery tool, for example a basket, a fork, slings or turnbuckles, enabling the grasping of the parts left on the supplied ship. Once the recovery tool has been put into place, the transfer system is again extended in order to bring back the parts of the transfer system remaining on the receiving boat. During this phase, the coupling systems 5, 6 are secured on the recovery tool then brought aboard the supply ship in order to be inspected and reassembled on the transfer system. The reassembly of the ERS is thus carried out in full safety on board the supply ship and independently of the supplied boat.

The transfer system 1 described in this document enables the relative movements of the two ships to be followed when they remain within a predefined dynamic envelope. This predefined dynamic envelope constitutes a safety limit such that when that limit is reached, the transfer system 1 is, if compatible with the overall static envelope, repositioned through displacement of the static part so as to make the relative movements coincide with the predefined dynamic envelope. If the repositioning is not possible, at a static envelope extremity for example, emergency release of the transfer system 1 is carried out.

Figure 4:
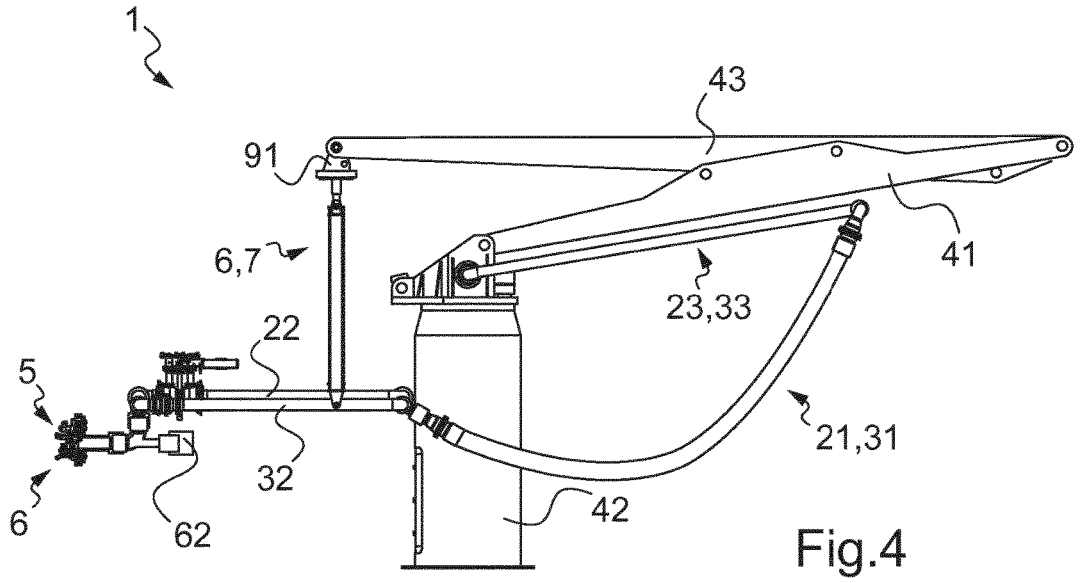
FIG. 4 is a perspective view of the transfer system of FIG. 1 in a storage position.

FIG. 4 illustrates the transfer system 1 according to the embodiment described, in storage position. In this storage position, the outer branch 43 is folded above the inner branch. The coupling systems 5, 6, the first rigid sections of pipe 22, 32 and the suspension arms 7, 8 are disposed in this order upstream of the base 42. The folding of the outer branch 43 around the inner branch 41 is allowed by the pivot connection linking the two branches, the inner one 41 and the outer one 43. The articulated assemblies are locked in the storage position. In the storage position, the coupling systems 5, 6 are accessible for maintenance.

Figure 5:
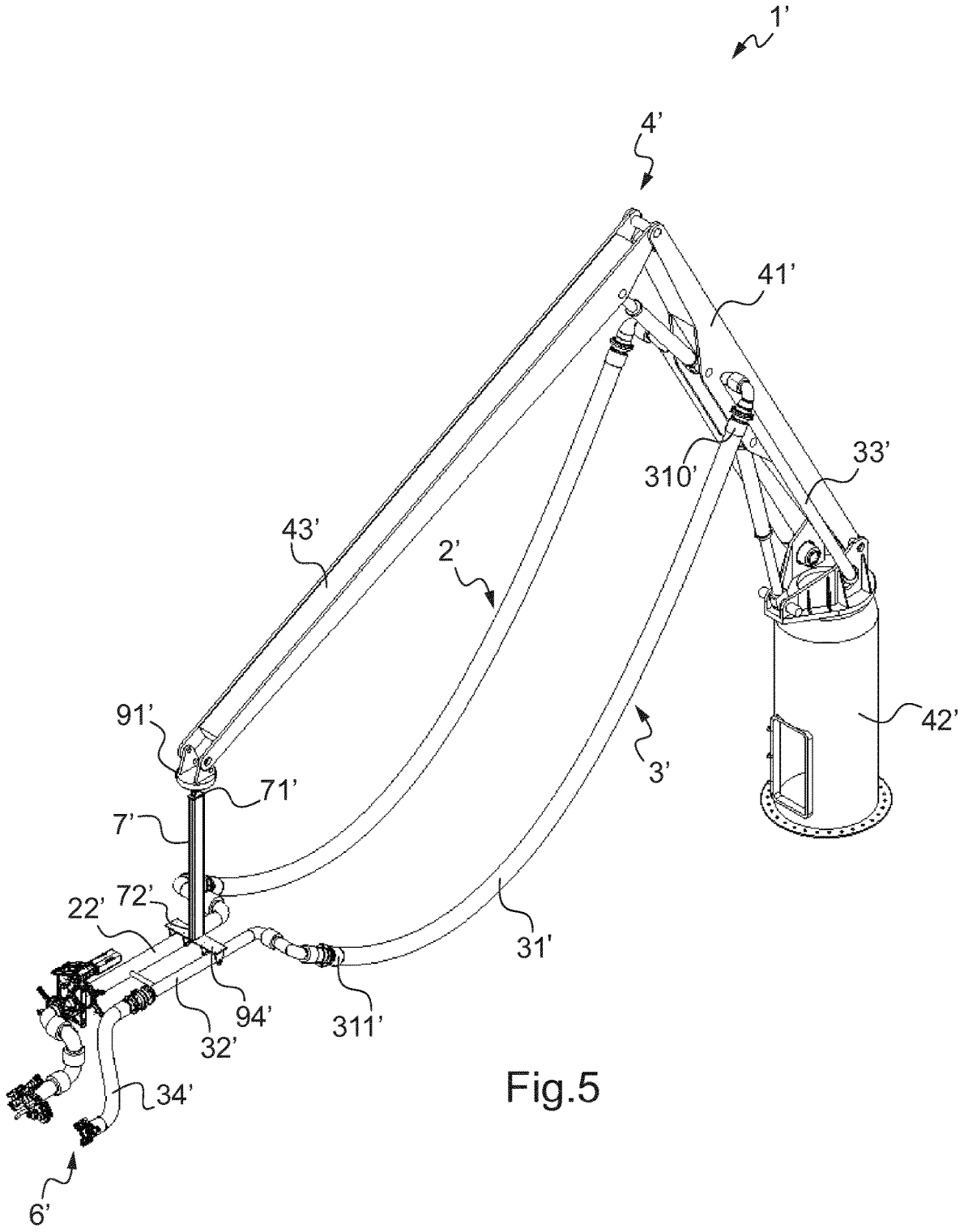
FIG. 5 is a perspective view of the system for transfer of a fluid product according to a second embodiment.

FIG. 5 represents the transfer system 1' according to a second embodiment in accordance with the invention.

As for the first embodiment, the transfer system 1' comprises a first pipe 2' or liquid line, and a second pipe 3' or vapor line, and a support structure 4'. The first pipe 2' and the support structure 4' are here similar to those described in the first example embodiment and will therefore not be the subject of an additional description for this embodiment.

The second pipe 3' comprises several sections connected to each other by fluid-tight articulations. In this example embodiment, the second pipe 3' comprises four sections. The pipe 3' comprises a flexible section of pipe 31' of which opposite locations are connected to a first rigid section of pipe 32' and to a second rigid section of pipe 33'. A flexible portion 34' or second flexible section of pipe is connected to the first rigid section of pipe 32'. Similarly to the first example described, the first rigid sections of pipe 22', 32' of the two pipes 2', 3' extend horizontally.

As for the first example embodiment, the flexible section of pipe 31' is connected to the second rigid section of pipe 33' at a proximal end 310' of the flexible section of pipe 31'. The second rigid section of pipe 32' is carried by the inner branch 41'. The first rigid section of pipe 32' is connected to a distal end 311' of the flexible section of pipe 31'. Thus, in this embodiment, the three pipe sections 31', 32', 33' are similar to those described for the first embodiment. The fluid-tight articulations between the three sections 31', 32', 33' as well as between the second section 33' and the base 42' and the degrees of freedom allowed by these articulations are also the same as those described previously.

In this embodiment, the flexible portion 34' is provided at its free end with a coupling system 6'. As described above, the coupling system 6' is configured for the connection of the pipe 3' to a target duct 11.

In contrast to the first embodiment, the second pipe 3' comprises five swivel joints instead of eight. In other words, three degrees of rotational freedom are taken by the hose 34'. The rigid section of pipe 32' is connected at its end to a flexible part; the flexible portion 34'.

This makes it possible to lighten the dynamic part of the transfer system. Furthermore, this facilitates the connection to the target ducts on opposite sides of the target duct 10 by virtue of the flexibility of the flexible portion 34'.

As for the first embodiment, the transfer system 1' comprises a clevis 91' connected to the outer branch 43' by a horizontal axis pivot connection. The clevis 91' is connected here to a suspension arm 7' comprising a first end 71' and a second end 72'. The suspension arm 7' extends vertically here. The clevis 91' is connected to the suspension arm 7' by two horizontal axis pivot connections at the first end 71'. In this embodiment, the horizontal axis pivot connection between the clevis 91' and the suspension arm 7' corresponds to the horizontal axis pivot connection described for the first embodiment which connects the cross-member 92 and the suspension arms 7, 8. The vertical axis pivot connection between the clevis 91' and the suspension arm 7' corresponds to the vertical axis pivot connection between the clevis 91 and the cross-member 92 described for the first embodiment. In other words, in both embodiments, the first rigid sections of pipe are suspended from the outer branch by suspension means (suspension arms here), via articulation means allowing one rotational movement with a vertical axis and two rotational movements with a horizontal axis.

The suspension arm 7' is connected at the second end 72' to a bar 94'. The bar 94' here extends horizontally. The bar 94' is connected at opposite locations to the rigid sections of pipe 22', 32' by a horizontal axis pivot connection on each side. The suspension arm 7' and the bar 94' form a T. The suspension arm 7' and the bar 94' enable the suspension of the rigid sections of pipe 22', 32' from the outer branch 43'.

The suspension arm 7' and the bar 94' form an alternative to the rigid suspension described for the first embodiment and comprising two suspension arms linked by a cross-member.

Figure 6:
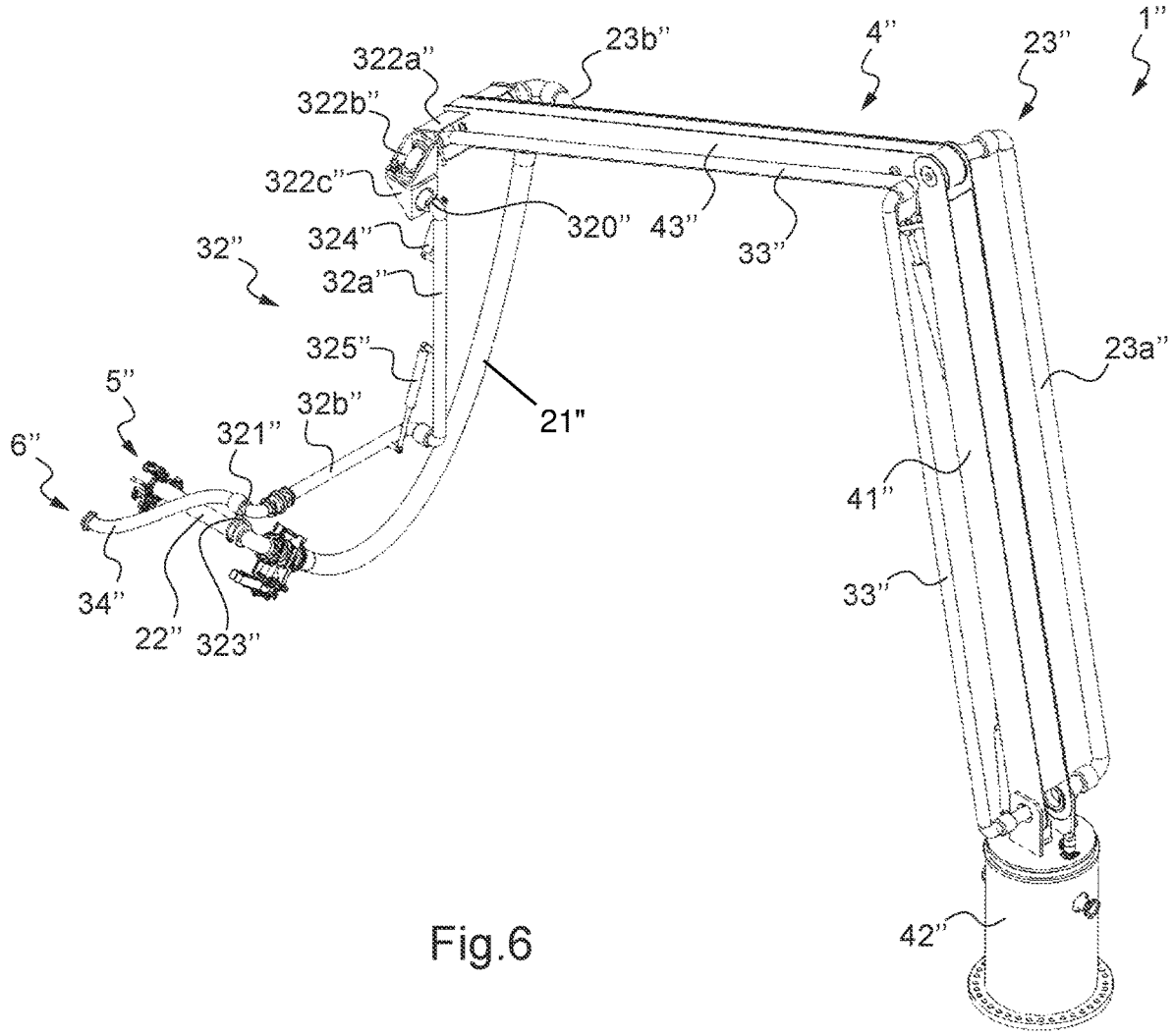
FIG. 6 is a perspective view of the system for transfer of a fluid product according to a third embodiment.

FIG. 6 represents the transfer system 1" according to a third embodiment in accordance with the invention. The support structure 4" is similar here to that described in the first and second example embodiments and will therefore not be the subject of an additional description for this embodiment.

The transfer pipes 2", 3" comprise several sections connected to each other by fluid-tight articulations. In this example embodiment, the pipes 2", 3" each comprise three sections. The pipe 2" comprises a flexible section of pipe 21" of which opposite locations are connected to a first rigid section of pipe 22" and to a second rigid section of pipe 23".

In contrast to the foregoing embodiments, the second rigid section of pipe 23" is carried by the inner branch and by the outer branch. The second rigid section of pipe 23" comprises two parts 23*a*", 23*b*" linked together by fluid-tight articulations allowing two degrees of rotational freedom. A first part 23*a*" of the second rigid section of pipe 23" is carried by the inner branch 41" and a second part 23*b*" of the second rigid section of pipe 23" is carried by the outer branch 43". The end of the second rigid section of pipe 23" connected to the base 41" comprises two articulated assemblies having two joints and two elbow bends enabling two rotational movements, one of horizontal axis and one of vertical axis. The end of the second rigid section of pipe 23" connected to the flexible section of pipe 21" also comprises three articulated assemblies having three swivel joints and at least three elbow bends and allowing three rotational movements; two rotational movements of horizontal axis and one rotational movement of vertical axis equivalent to a ball joint.

The first flexible section of pipe 21" is connected to the first rigid section of pipe 22" by means of an articulated assembly enabling one rotational movement. The free end of the first rigid section of pipe 22" is provided with a coupling system 5" configured to be connected to a target duct 10".

The first pipe 2" thus comprises seven swivel joints, three in the static part and four in the dynamic part.

The second pipe 3" comprises a first rigid section of pipe 32" connected by opposite locations to a flexible section of pipe or flexible portion 34" and a second rigid section of pipe 33".

The second rigid section of pipe 33" of the second pipe 3" is similar here to the second rigid section of pipe 23" of the first pipe 2".

The first rigid section of pipe 32" of the second pipe 3" is formed here in two parts; a part that is normally vertical 32*a*" and a part that is normally horizontal 32*b*". By normally horizontal and vertical is meant the nominal position, the two parts 32*a*", 32*b*" forming a compass of variable angle. The first rigid section of pipe 32" is connected to the second rigid section of pipe 33" at an upper end 320" of the vertical part 32*a*" by means of articulation assemblies allowing three degrees of rotational freedom, these being horizontal ones and a vertical one. The articulation assemblies comprise three housings 322*a*", 322*b*", 322*c*" which, as is visible in FIG. 6, surround the elbow bends and swivel joints. The housing 322*a*" or upper housing is connected to the outer branch 43". The three housings 322*a*", 322*b*", 322*c*" are disposed substantially so as to form an L. The three housings 322*a*", 322*b*", 322*c*" respectively allow a rotational movement of horizontal axis, a rotational movement of vertical axis and a rotational movement of horizontal axis.

The vertical part 32*a*" is connected to the horizontal part 32*b*" by means of an articulation assembly allowing a rotational movement of horizontal axis. The two parts 32*a*", 32*b*" of the first rigid section of pipe 32" may thus move and take the position desired by the operator. The angle formed between the two parts 32*a*", 32*b*" varies according to the positions occupied by each of the parts 32*a*", 32*b*". The first rigid section of pipe 32" is connected to the flexible portion 34" at a lower end of the horizontal part 32*b*" by means of an articulation assembly allowing a rotational movement of horizontal axis.

The second pipe 3" thus comprises eight swivel joints, four in the static part and four in the dynamic part. The various articulation assemblies present in the two pipes 2" and 3" makes it possible to enlarge the zone of coverage of the transfer system 1".

The first rigid section of pipe 32" of the second pipe 3" comprises assembly means 323", for example a universal joint, allowing two rotational movements, one of horizontal axis, one of vertical axis, between the two pipes 22" and 32". The assembly means 323" enable the fastening of the first rigid section of pipe 32" to the first rigid section of pipe 22" of the first pipe 2" The second pipe 3" and in particular the first rigid section of pipe 32" serves as suspension means for the first rigid section of pipe 22". This makes it possible to dispense with the use of a yoke and of a suspension arm connected to a bar, which are used in the other described embodiments. The assembly means 323" may be provided with actuators of jack or motor type. As for the other two embodiments, the first rigid section of pipe 22" is suspended from the outer branch by suspension means (the rigid section of pipe 32" here), via articulation means (housings 322*a*", 322*b*", 322*b*") allowing one rotational movement with a vertical axis and two rotational movements of horizontal axis.

The articulated assemblies of the first rigid section of pipe allow several degrees of freedom and thereby make it possible to better position the pipes in the connection phase. The movements of the parts 32*a*", 32*b*" may be controlled by actuators 324", 325".

In the connection phase, the transfer system 1" is brought towards the target ducts. The second pipe 3" is connected to the first pipe 2" by the assembly means 323". The first pipe 2" is connected to the associated target duct 10". The second pipe 3" is then detached from the first pipe 2". The flexible portion 34" is lastly connected to an associated duct 11" by means of a coupling system 6".

As for the second embodiment, the flexible portion 34" enables the connection to the target ducts 11" on opposite sides of the target duct 10".

The transfer systems 1', 1" according to the second and the third embodiments have a few differences detailed earlier relative to the transfer system 1' according to the first embodiment. The kinematics of the transfer systems 1', 1" for connection and for disconnection however remain the same as those explained for the transfer system 1' according to the first embodiment.

More generally, such a transfer arm 1, 1', 1" has the following particularities and advantages:

- Connection rendered secure and not requiring manual intervention (remote control);
- Mastery of the dynamic envelope making it possible to take up the movements of the swell during loading;
- Large static envelope;
- Small number and size of members of the transfer system in movement during the supply;
- No use of cable or winch. No need to compensate for the forces due to the wind or a tension force of a cable for example. No need for an accompanying system for dropping as generally used for flexible pipes at the time of an emergency release;
- Hybrid transfer system enabling its performance to be optimized. Number of articulated assemblies limited to a maximum of eight per pipe line as opposed to ten for a fully rigid transfer system of the prior art. Length of the flexible sections of pipe reduced compared to that of a compass type transfer system of the prior art;
- Behavior of the transfer system predictable, for example by means of sensors, by virtue of the presence of continuous articulated rigid parts;
- Compact storage of the transfer system;
- Balancing of the coupling systems enabling the coupling systems to remain in vertical position and within an angle of tolerance enabling their connection to the target ducts;
- The flexible sections of pipes enable complete or partial balancing of the rigid sections of the transfer system and in particular the first rigid sections of pipe for the first embodiment.
- Emergency release controlled;
- Connection possible on both sides of the supply ship (port and starboard);
- The transfer system may be connected to a Floating Storage and Regasification Unit (FSRU) or to a methane tanker.
- The transfer system may also be connected to a methane tanker quay or terminal.
- The various degrees of freedom enabled by the articulated assemblies enable the transfer system to have a large coverage zone. The various sections can turn in different directions and thereby adopt different positions.

Naturally, the present invention is not limited to the embodiments described above.

In another example embodiment, the number of transfer pipes may be different, for example a single liquid pipe or more than two pipes.

The flexible sections of pipes may be replaced by articulated rigid sections of pipes comprising swivel joints to form a compass or a small chain), and vice-versa.

The transfer system may comprise a video camera at the end of the rigid structure in order to enable the monitoring of the loading operation, in particular at the location of the target ducts.

The invention claimed is:

1. A system for transfer of a fluid product, the system comprising:

a first transfer pipe for the fluid product having an end provided with a first coupling system configured for the connection of the first transfer pipe to a first target duct;

a support structure for the first transfer pipe, the support structure comprising an inner branch which is mounted on a base and an outer branch;

wherein the first transfer pipe comprises a first flexible section of pipe having a proximal end suspended from the support structure and a distal end to which a first rigid section of pipe is connected, the first rigid section of pipe having a free end to which the first coupling system is connected; and wherein the transfer system comprises suspension means configured for rigidly suspending thereof the first rigid section of pipe from the outer branch via articulation means permitting rotation around a vertical axis and at least one horizontal axis.

2. The system according to claim 1, wherein at least one of the first and second coupling systems is equipped with an emergency release system comprising two valves which are juxtaposed using a collar of which the opening is controlled by at least one actuator which also controls the closing of the valves.

3. The system according to claim 1, wherein the articulation means comprise a rolling bearing with a vertical rotational axis which is joined to a clevis connected by a pivot connection to the outer branch.

4. The system according to claim 1, wherein the inner branch has a first end which is rotatably mounted on the base around a first horizontal axis, and wherein the outer branch is connected to a second end of the inner branch, at a second end located opposite the first end, by a pivot connection enabling the outer branch to turn around a second horizontal axis extending parallel to the first horizontal axis of the inner branch.

5. The system according to claim 4, wherein the inner branch is rotatably mounted on the base around a vertical axis.

6. The system according to claim 4, wherein the pivot connection connecting the outer branch to the inner branch is adapted to enable folding of the outer branch onto the inner branch in a storage position of the system.

7. The system according to claim claim 5, further comprising actuating means to actuate the rotational movements of the inner and outer branches.

8. The system according to claim 1, further comprising a second transfer pipe for transfer of fluid product, the second transfer pipe comprising an end provided with a second coupling system for the connection of the second transfer pipe to a second target duct and a second rigid section of pipe located upstream of the second coupling system.

9. The system according to claim 8, wherein the second transfer pipe comprises a flexible portion disposed between the second rigid section and the second coupling system.

10. The system according to claim 8, wherein the suspension means are formed by a portion of the second rigid section of pipe the second rigid section of pipe comprising assembly means enabling the fastening of the second rigid section of pipe to the first rigid section of pipe.

11. The system according to claim 3, wherein the second rigid section of pipe comprises two parts forming a compass of variable angle.

12. The system according to claim 8, further comprising actuating means for actuating the rotational movements of the suspension means and/or of the first and second rigid section or sections of pipe.

13. The system according to claim 12, wherein the actuating means comprised a jack or a motor for each rotational movement to actuate.

14. The system according to claim 8, wherein at least one of the first and second coupling systems comprises a coupler with three degrees of rotational freedom.

15. The system according to claim 14, at least one of the first and second coupling systems comprises a balancing device suitable for maintaining the coupler in a position enabling its connection to its associated target duct.

16. The system according to claim 8, wherein the second transfer pipe comprises a second flexible section of pipe having a distal end which is connected to the second rigid section of pipe, and wherein a proximal end of at least one of the first and second flexible sections of pipe is connected to a respective third rigid section of pipe carried by one of the inner branch or by the outer branch.

17. The system according claim 16, wherein at least one of the first and second flexible sections of pipe is articulated to its associated first or second rigid section of pipe with two degrees of rotational freedom.

18. The system according to claim 8, wherein the suspension means comprise a first suspension arm having a first end connected to the outer branch.

19. The system according to claim 18, wherein the first suspension arm comprises a second end, located opposite the first end, which is connected to a bar that in turn is connected to the first and second rigid sections of pipe by respective horizontal pivot connections, and wherein the suspension arm and the bar together form a T.

20. The system according to claim 18, wherein the suspension means comprise a second suspension arm connected to the outer branch via articulation means, wherein each of the two first and second suspension arms is connected to a corresponding one of the first and second rigid sections of pipe by a pivot connection of horizontal axis, and wherein the first and second suspension arms are connected to each other by a cross-member forming a yoke with the articulation means and bearing the two suspension arms.

* * * * *